United States Patent [19]

Yoshikawa

[11] Patent Number: 4,905,627

[45] Date of Patent: Mar. 6, 1990

[54] PORTABLE ELECTROSTATIC FLOCKING DEVICE

[76] Inventor: Satonobu Yoshikawa, 12-1 Kabuto-cho, Nihonbashi, Chuo-ku, Tokyo, Japan

[21] Appl. No.: 344,889

[22] Filed: Apr. 28, 1989

[30] Foreign Application Priority Data

May 26, 1988 [JP] Japan ..... 63-6988

[51] Int. Cl.[4] ..... B05B 5/04

[52] U.S. Cl. ..... 118/621; 427/26

[58] Field of Search ..... 118/308, 621; 427/26

[56] References Cited

U.S. PATENT DOCUMENTS 2,173,032 9/1939 Wintermute ..... 427/26

FOREIGN PATENT DOCUMENTS 1081124 12/1954 France ..... 118/621
51-25569 6/1976 Japan .
52-9906 3/1977 Japan .
52-9907 3/1977 Japan .

*Primary Examiner*—Willard Hoag
*Attorney, Agent, or Firm*—Armstrong, Nikaido, Marmelstein, Kubovcik & Murray

[57] ABSTRACT

A portable electrostatic flocking device which comprises a horizontal hollow handle rod, high voltage producing means housed in the handle rod, a drive motor provided below the rod and having a gear mounted on the output shaft of the motor, a hollow rotary shaft housed in the rod and having an inner lead, a gear in engagement with the gear on the motor output shaft and an extension extending beyond the adjacent end of the rod and a rotary container connected to the rotary shaft to be rotated by the shaft. The interior of the rotary container is divded into a plurality of compartments by a plurality of radially extending partition walls and the bottoms of the compartments are connected to the lead for the rotary shaft by means of branch leads branched from the rotary shaft lead.

3 Claims, 2 Drawing Sheets

PORTABLE ELECTROSTATIC FLOCKING DEVICE

BACKGROUND OF THE INVENTION

This invention relates to small size portable electrostatic flocking device.

There have been proposed a number of prior art small size portable electrostatic flocking devices and some of the prior art electrostatic flocking devices are shown in Japanese U.M. Appln. Publications Nos. 25569/1976, 9906/1977 and 9907/1977, respectively. U.M. Appln. Publication No. 25569/1976 discloses an electrostatic flocking tray which comprises a framework substantially U-shaped cross-section 3 formed of an insulative material and having a support surface, a partition board 6 positioned adjacent to the opening 11 of said framework 3 and spaced above the base 3*b* of the framework, a screen type electrode 7 positioned between said partition board 6 and base 3*b* spaced from them, a screen 12 positioned above said screen type electrode 7 and a detachable shielding board 8 covering the undersurface of said framework 3. U.M. Appln. Publication No. 9906/1977 discloses a material container for use on job side to control the flying range of said material in the electrode position thereof which comprises a shallow material holding tray 1 formed on an electrically insulative material and having side and end walls extending outwardly from the central region of the tray at an obtuse angle and wherein an electrode region 3 is provided on the bottom of said tray and a triangular inductive electrode region 8 is formed by said electrode region 3 in a position closely adjacent to the latter, said inductive electrode region 8 being defined by the opposing ends of one side wall and the adjacent end wall having the apex positioned at the upper end of said material holding tray. U.M. Appln. Publication No. 9907/1977 discloses a paint tray in an electrostatic painting device which comprises a framework 1 and a bottom board 3 having a T-shaped tubular member secured to a central area of the undersurface of the bottom board to be fitted into a grip cylinder, said bottom board 3 being adapted to be fitted into bottom of said framework.

However, in any one of the prior arts disclosed in these U.M. Application Publications, the container adapted to hold fibers or other fine particles (which will be referred to as "fibers" hereinafter), electrically charge the fibers and direct the charged fibers to an article to be flocked with the fibers is fixedly secured to a hand grip structure. Thus, when the fibers are evenly piled up within the container, the fibers can be relatively uniformly charged, caused to fly to the article to be flocked with the fibers and deposited on the surface of the article, but if the fibers are unevenly piled up within the container, when flocking operation is conducted with the fibers maintained in the unevenly piled up condition, the fibers within the container cannot be easily charged to thereby make it impossible to deposit or flock the fibers on the article in a predetermined desired condition.

SUMMARY OF THE INVENTION

Thus, the present invention has its object to provide a novel and improved portable electrostatic flocking device which can effectively flock fibers on an article to be flocked with the fibers while eliminating the drawbacks inherent in the prior arts described hereinabove.

To attain the object, according to the present invention, fibers are held and charged within a rotary container and the charged fibers are caused to fly out of the container to an article to be flocked with the fibers and specific electrodes erect on the bottoms of compartments defined by partition walls within the container whereby the charged fibers can effectively fly to the surface of the article and uniformly flock the article while eliminating the drawbacks such as uneven flocking inherent in the prior arts.

For the purpose, according to the present invention, the portable electrostatic flocking device comprises a hollow handle rod, high voltage producing means housed in the handle rod, a motor provided below the handle rod and connected to the high voltage producing means by a lead extending from the high voltabe producing means, a rotary shaft extending through a portion of the handle rod with one end portion of the shaft extending beyond the adjacent end of the handle rod and adapted to be rotated by the motor through a transmission, a cylindrical rotary container attached to the rotary shaft for holding fine particles, a plurality of compartments defined within the container by a plurality of radially extending partition walls having notches, conductive boards provided on the bottoms of the compartments, a plurality of triangular electrodes erecting on the conductive boards and connected to the above-mentioned lead and branch leads and a screen or perforated sheet detachably attached to the cylindrical container.

According to the present invention, there is provided a portable electrostatic flocking device which comprises a horizontal hollow handle rod consisting of first and second sections; high voltage producing means housed in said second section and having at one end a lead connected to an external power source and at the other end a high voltage contact terminal; a drive motor provided below said second section and having at one end a lead connected to a second external power source and at the other end the output shaft on which a gear is mounted; a horizontal hollow rotary shaft exttending within said second section and having at one end a first high voltage contact terminal in engagement with said contact terminal on the high voltage producing means and at the other end an extension extending beyond the adjacent end of said second section and including a second high voltage contact terminal at the extreme end of said extension, said rotary shaft further having a gear between the two contact terminals of the shaft in engagement with said gear on the motor output shaft; a rotary container for holding fine particles connected to said rotary shaft to be rotated thereby, the interior of said rotary container being divided into a plurality of compartments defined by a plurality of partition walls extending radially between the interior of said rotary container and said extension of the rotary shaft; a boss of U-shaped cross-section on said rotary container having a high voltage contact terminal in engagement with said second contact terminal of the rotary shaft; a lead for said rotary shaft extending from said first contact terminal through said second terminal of the rotary shaft and said contact terminal of the boss into said interior of the rotary container; conductive boards on the bottoms of said compartments; triangular electrodes erecting from said conductive boards; and branch leads branched from said lead for the rotary shaft and connected to said conductive boards.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
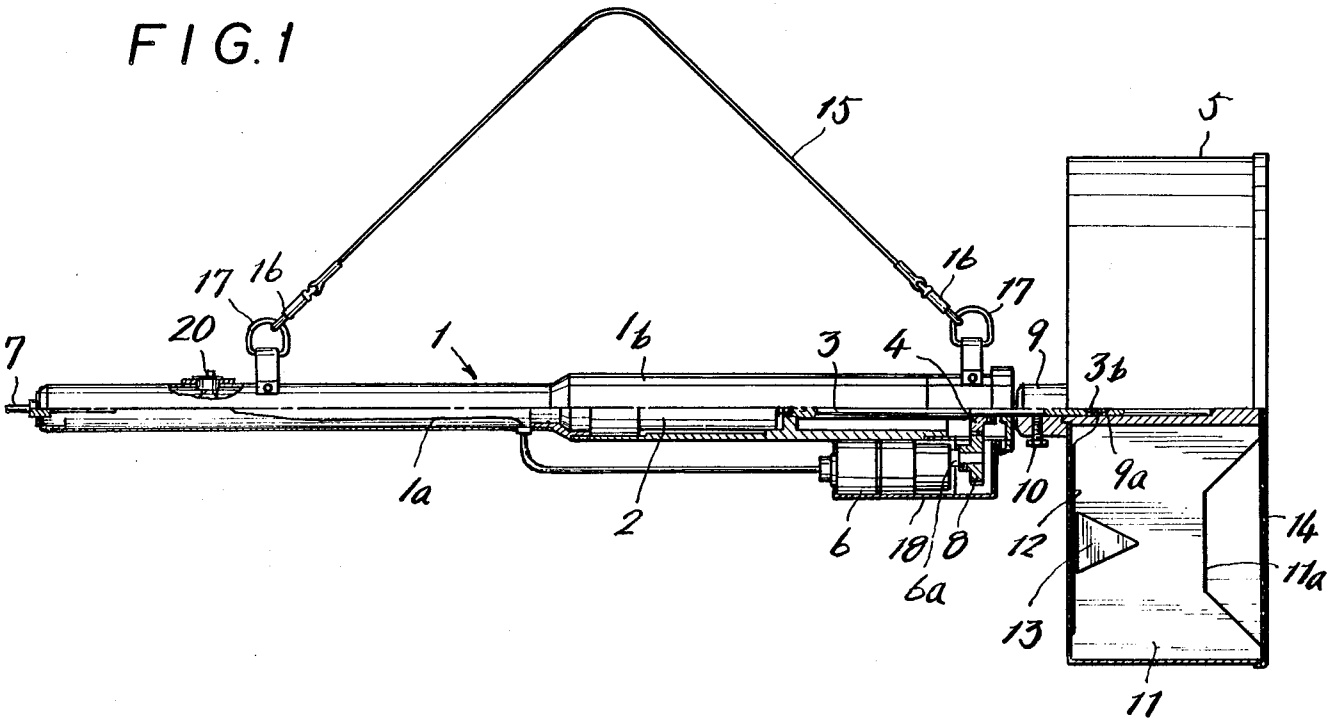
FIG. 1 is a side elevational view in partial section of the embodiment of the portable electrostatic flocking device according to the present invention with a portion thereof cut away.
Figure 2:
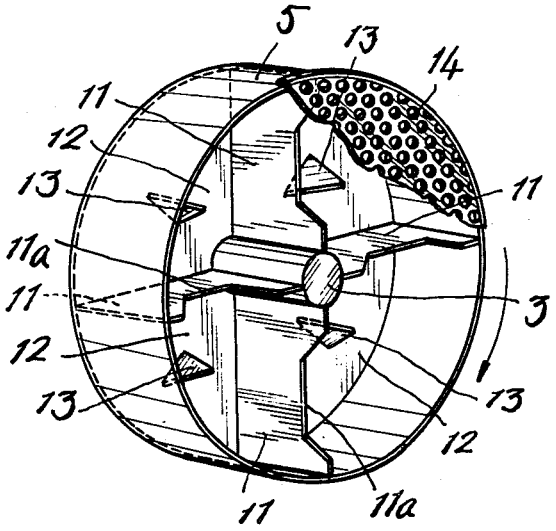
FIG. 2 is a perspective view of the fiber container of the electrostatic flocking device.
Figure 3:
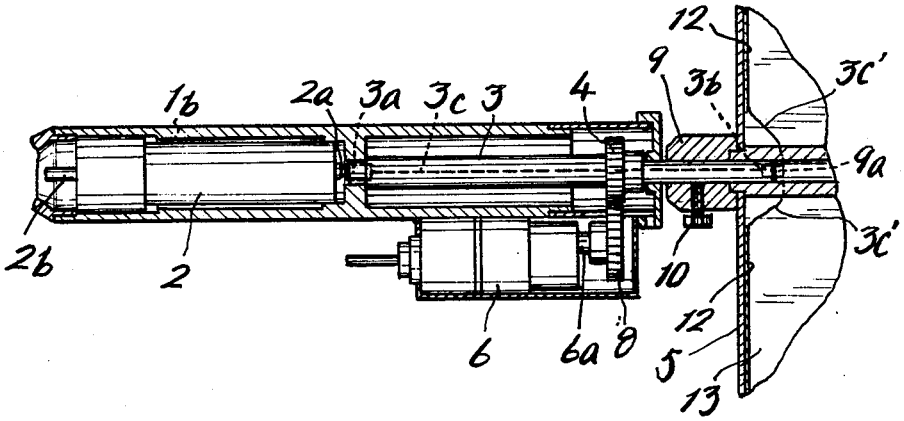
FIG. 3 is a fragmentary side elevational view on an enlarged scale of the drive and transmission mechanism of the electrostatic flocking device.

The present invention will be now described referring to the accompanying drawings in which the preferred embodiment of the portable electrostatic flocking device constructed in accordance with the present invention is shown for illustration purpose only, but not for limiting the scope of the same in any way. In FIG. 1, reference numeral 1 denotes a horizontal hollow handle rod which consists of a smaller diameter section (a first section) 1*a* and a larger diameter section 1*b* (a second section). High voltage producing means 2 is mounted within the second section 1*b* in a portion thereof adjacent to the first section 1*a* and connected to an external power source (not shown) through a cable 3' to support a container 5 of which description will be made hereinafter. A rotary shaft 3 is suitably supported within the second section 1*b* in a portion thereof remote from the first section 1*a* with the outer end portion of the shaft extending outwardly beyond the outer end of the second section 1*b* to support a container 5 of which description will be made hereinafter. The high voltage producing means 2 is provided at one or the inner end with a high voltage contact terminal 3*a* which always engages a high voltage contact terminal 3*a* at the inner end of the rotary shaft 3. The other or outer end of the rotary shaft 3 is provided with another high voltage contact terminal 3*b* and a lead 3*c* extends within the shaft between the terminals 3*a*, 3*b*. A gear 4 is mounted on the rotary shaft 3 in a mid point between the opposite ends of the shaft 3. A motor 6 is provided below the second section 1*b* of the handle rod 1 and connected to an external power source (not shown) through a lead 7 which extends from the motor 6 through the hollow first section 1*a* of the rod 1. The output shaft 6' of the motor 6 carries a gear 8 which meshes the gear 4 on the shaft 3 whereby the rotary shaft 3 is rotated by the motor 6 through the transmission mechanism comprising the gears 4, 8. The container 5 is rotatably supported on the outer end of the rotary shaft 3 and secured to the shaft portion by means of a boss 9 of U-shaped cross-section which may be integrally formed with the container or be a separate member suitably attached to the container on the container 5 and a bolt 10 screwed in the threaded vertical hole in the boss 9.

The container 5 is formed of insulative material and comprises a cylindrical body having a substantially closed inner side wall and an open outer side wall. The inner side wall of the cylindrical body and the boss have aligned ceter. The interior of the container 5 is divided into compartments by a plurality of partition walls 11, 11 . . . which extend radially between and are secured at the opposite ends of the inner surface of the cylindrical body and the outer end portion of the rotary shaft 3 so that the container can rotate together with the shaft. Each partition wall 11 has a notch 11*a* in the central region on the side thereof opening towards the open outer side wall of the cylindrical body 5. A conductive board 12 is secured to the bottom of each compartment and a triangular conductive board or induction electrode 13 is secured to and erects from each conductive board 12 with one apex thereof directing towards the open outer side wall of the cylindrical body.

Furthermore, a screen or perforated sheet 14 is detachably secured to the outer side wall of the cylindrical body and extends across the whole open area of the side wall. In the illustrated embodiment, the boss 9 is secured to the outer surface of the inner side wall of the cylindrical body concentric to the latter and has center bore in alignment with the bore in the inner side wall of the cylindrical body so that the outer end portion of the rotary shaft 3 can pass through the cylindrical body inner side wall and boss and the threaded bore extending right angles to and communicating with the center bore in the boss.

In addition, a high voltage contact terminal 9*a* is provided within the boss 9 for engagement with voltage contact terminal 3*b* at the outer end of the rotary shaft 3 and high voltage static electricity is sent from the high voltage producing means 2 through the terminals 2, 3*a*, lead 3*c* and high voltage contact terminal 3*b* to the branch leads 3*c'* branched from the lead 3*c* and extending to the conductive boards 12 on the compartment bottoms whereby the electricity is conducted to the conductive boards 12. It is also contemptated that the outer end portion of the rotary shaft 3 terminates within the boss 9 and the partion walls 11, 11 . . . are secured to the inner surface of the cylindrical body and intersect each other at right angles.

In FIG. 1, reference numeral 15 denotes a sling having at the opposite ends hooks 16 for engaging with rings 17 secured to the first and second sections 1*a*, 1*b* of the handle rod 1, respectively and with the above-mentioned construction, the electrostatic flocking device can be carried to any desired place and reference numeral 18 in FIG. 1 denotes the casing for the motor 6, shaft 6' and gear 8. Reference numeral 20 denotes a switch which is common to the high voltage producing means 2 and motor 6.

For storaging the device, the bolt 10 is unscrewed out of the threaded bore in the boss 9 and the container 5 is detached from the rotary shaft 3. In conducting an electrostatic flocking operation at a desired place, the device is first carried to the desired place and the container 5 is secured to the rotary shaft 3 by screwing the bolt 10 into the threaded bore in the boss 9. The screen or perforated sheet 14 is detached from the cylindrical body and fine particles such as fibers are thrown into the container 5. Thereafter, the screen 14 is replaced to the cylindrical body.

Next, the container 5 is directed to a grounded work (not shown) which is to be flocked and has adhesive applied thereto. Thereafter, the high voltage producing means 2 and motor 6 arae energized by the switch 20 to produce high voltage static electricity and rotate the rotary shaft 3 which in turn rotates the container 5.

The high voltage static electricity produced by the high voltage producing means 2 is sent to the conductive boards 12 on the bottoms of the compartments in the cylindrical body via the high voltage contact terminals on the high voltage producing means 2, rotary shaft 3 and boss 9 whereby the fine particles such as fibers are electrically charged. Although the conductive boards 12 on the bottoms of the compartments themselves function as electrodes, according to the present invention, since the triangular conductive boards 13 with one apex thereof directing to the outer side wall of the container cylindrical body serve conductive electrodes and the conductive boards 13 cause the charged fibers to effectively fly out of the container 5 through the screen 14.

One feature of the present invention is that the container 5 comprises a cylindrical body, the interior of which is divided into a plurality of compartments by partition walls radially extending and each compartment has a triangular conductive electrode board erecting from the inner side wall of the cylindrical body. Thus, effectively charged fine particles such as fibers fly from the compartments through the screen to the article to be flocked with the fibers.

Another feature of the present invention is that since the radially extending partition walls are notched as mentioned hereinabove, the fine particles held in the compartments of the container cylindrical body will not be unevenly distributed into the respective compartments and retained therein, but move from respective compartments into adjacent compartments through the notches in the successive radially extending partition walls while the container 5 is rotating the respective compartments hold the fine particles in a substantially equal amount to thereby eliminate the possibility that a particular compartment or compartments are completely emptied.

Furthermore, since the erected conductive boards are formed in a triangle shape, the fine particles held in the respective compartments can be effectively charged by the rotation of the container without contacting the surfaces of the triangular conductive elecrode boards.

From the above description, it is apparent that in operation the respective compartments hold fine particles in a substantially equal amount, a mass or masses of fine particles are disintegrated and the triangular conductive electrode boards effectively charge fine particles.

While one preferred embodiment of the invention has been shown and described in detail, it will be understood that the same is for illustration purpose only and not to be taken as a definition of the invention, and reference should be given to the appended claims for that purpose.

What is claimed is:

1. A portable electrostatic flocking device comprising a horizontal hollow handle rod consisting of first and second sections; high voltage producing means housed in said second section and having at one end a lead connected to an external power source and at the other end a high voltage contact terminal; a drive motor provided below said second section and having at one end a lead connected to a second power source and having at the other end the output shaft on which a gear is mounted; a horizontal hollow rotary shaft extending with said second section and having at one end a first high voltage contact terminal in engagement with said contact terminal on the high voltage producing means and at the other end an extension extending beyond the adjacent end of said second section and including a second high voltage contact terminal at the extreme end of said extension, said rotary shaft further having a gear between the two contact terminals of the shaft in engagement with said gear on the motor output shaft; a rotary container for holding fine particles connected to said extention of the rotary shaft to be rotated thereby, the interior of said rotary container being divided into a plurality of compartments defined by a plurality of partition walls extending radially between the interior of said rotary container and said extension of the rotary shaft; a boss of U-shaped cross-section on said rotary container having a high voltage contact terminal in engagement with said second contact terminal of the rotary shaft; a lead for said rotary shaft extending from said first contact terminal through said second terminal of the rotary shaft and said contact terminal of the boss into said interior of the rotary container; conductive boards on the bottoms of said compartments; triangular electrodes erecting from said bottoms of the compartments; and branch leads branched from said lead for the rotary shaft and connected to said conductive boards.

2. The portable electrostatic flocking device as set forth in claim 1 wherein said rotary container is in the form of a cylindrical body and includes a substantially closed inner side wall having a center bore and an open outer side wall to which a screen is detachably attached.

3. The portable electrostatic flocking device as set forth in claim 2 wherein said boss is on the outer surface of said inner side wall of the rotary container and has a center bore in alignment with said center bore in the container inner side wall whereby said extension of the rotary shaft extends through said boss and container inner side wall, said boss further including a threaded bore extending through the wall of the boss at right angles to the center bore in the boss for receiving a bolt which connects the boss to the rotary shaft.electrodes, according to the present invention, since the triangular conductive boards 13 with one apex thereof directing to the outer side wall of the container cylindrical body serve conductive electrodes and the conductive boards 13 cause the charged fibers to effectively fly out of the container 5 through the screen 14.

* * * * *

UNITED STATES PATENT AND TRADEMARK OFFICE

CERTIFICATE OF CORRECTION

PATENT NO. : 4,905,627

DATED : March 6, 1990

INVENTOR(S) : YOSHIKAWA

It is certified that error appears in the above-identified patent and that said Letters Patent is hereby corrected as shown below:

On the cover page, Item [30], "63-6988" should read --63-69888--.

Signed and Sealed this

Twenty-third Day of July, 1991

*Attest:*

*Attesting Officer*

HARRY F. MANBECK, JR.

*Commissioner of Patents and Trademarks*